United States Patent [19]

Sasaki et al.

[11] Patent Number: 4,734,612

[45] Date of Patent: Mar. 29, 1988

[54] HIGH PRESSURE METAL VAPOR DISCHARGE LAMP

[75] Inventors: Hiroki Sasaki, Yokohama; Kiyoshi Saita, Yokosuka; Akihiro Inoue, Chigasaki; Hiroyoshi Takanishi; Nobuyoshi Kuno, both of Yokohama, all of Japan

[73] Assignee: Kabushiki Kaisha Toshiba, Kawasaki, Japan

[21] Appl. No.: 878,667

[22] Filed: Jun. 26, 1986

[30] Foreign Application Priority Data

Jul. 15, 1985 [JP] Japan ..... 60-106968[U]
Oct. 18, 1985 [JP] Japan ..... 60-159516[U]

[51] Int. Cl.[4] ..... H01J 1/22; H01J 7/30
[52] U.S. Cl. ..... 313/15; 313/40
[58] Field of Search ..... 313/15, 19, 22, 25, 313/39, 40, 44, 45, 550, 551, 605, 627, 628, 629; 315/112, 115

[56] References Cited

U.S. PATENT DOCUMENTS 3,757,159 9/1973 Gutta et al. ..... 313/15 X
4,645,974 2/1987 Asai ..... 315/50

FOREIGN PATENT DOCUMENTS 514881 6/1974 Japan .

*Primary Examiner*—Leo H. Boudreau
*Assistant Examiner*—Sandra L. O'Shea
*Attorney, Agent, or Firm*—Oblon, Fisher, Spivak, McClelland & Maier

[57] ABSTRACT

A high pressure metal vapor discharge lamp including an outer bulb having a seal portion, an arc tube enclosed within the outer bulb, the arc tube having at least a pair of electrodes and containing at least a light emitting material and a rare gas, a pair of first lead wires of which one ends connect to the electrodes respectively and another ends mounted at the seal portion of outer bulb, a pre-heater disposed within the outer bulb, the pre-heater comprises a heat element and an insulating material covers the heat element and facing the arc tube to give the heat to the arc tube, and a second lead wires connected to the heat element of pre-heater, the portion of the second lead wires which are exposed in the outer bulb are surrounded by a heat-resisting insulator and the base portion of the second lead wires are mounted at the seal portion of outer bulb.

9 Claims, 7 Drawing Figures

HIGH PRESSURE METAL VAPOR DISCHARGE LAMP

BACKGROUND OF THE INVENTION

1. Field of the Invention

The present invention relates to a high pressure metal vapor discharge lamp, more specifically, relates to a small size high pressure metal vapor discharge lamp of 100W or less.

2. Discussion of Background

Generally, incandescent lamps are used for the light source for vehicle headlights. However, incandescent lamps have problems such as the facts that their light emission efficiency or efficacy is low and they have a short life, which means that the lamps have to be replaced frequently. As opposed to these, discharge lamps, which have high efficacy and a long life, are known as light sources. For example, fluorescent lamps which are low pressure discharge lamps, are used as lamps inside buses or electric trains. However it has not been possible to use fluorescent lamps as light sources for headlights since they would be too large. In view of this situation, there have been attempts at technical development to produce headlight light sources in the form of high pressure metal vapor discharge lamps, e.g., metal halide lamps or high pressure sodium lamps, which have a higher efficacy than fluorescent lamps and can easily be made compact. When such a discharge lamp is used, in view of aspects such as the size of the headlights, the required light intensity and consumption of the vehicle's batteries, etc., it is preferable to have a discharge lamp with a electricity consumption of 10W (watts) or less. However, one problem when a small size high pressure metal vapor discharge lamp such as this, e.g., a small size halide lamp, is used as a light source for headlights is taking long time for rising the lamp's luminous output. That is, on startingup of the lamp, there is hardly any vaporization of the mercury or metal halide sealed in the arc tube immediately after start-up and so there is only 10% luminous output at most of the lamp brightness that obtains rated operation. It usually takes 3–10 minutes for the arc tube to reach a high temperature and come into a stable lighting state and even if heat-holding effects are improved or the current at the time of start-up is made greater, the rise up time is still 30 seconds–1 minute, which makes practical applications difficult.

A way one can think of for resolving this problem is a system for starting an arc tube by effecting preheating with a heater, etc. For example, the publication of Japanese Laid-open Patent Application No. 51-4881 discloses a metal halide lamp wherein a guide for a heater is provided in the vicinity of the coldest portion of an arc tube and quartz wool is packed between the arc tube's coldest portion and the guide as a heat resisting electrical insulator. The object of this invention is to control the lamp's color temperature within a required range by adjusting the electric current in the heater coil, and whereby the heater coil temperature is changed and the temperature of the arc tube's coldest portion is controled arbitrarily from the exterior. And the invention can also be thought to be connected with improvement of the rise time so as to take short time, the problem noted above. However, since the heater coil is exposed inside an outer tube in a means such as this, depending on the height of pulses imposed at the time of lamp ignition, discharge between the heater coil and the arc tube's lead wires may occur inside the outer tube, so resulting in failure for sufficient pulse energy to be supplied to the lamp, and there is therefore a risk of start-up being uncertain. Also, since there is packing of quartz wool as described above between the arc tube and the heater coil, when the lamp is lit and preheating power is no longer supplied to the heater coil, the heat of the arc tube escapes to the exterior, transmitted by the contacting packing and heater coil. Therefore, there are the drawbacks that the heat-retention effects of the arc tube actually become lower, the efficacy is lower because of lowering of the vapor pressure by material sealed in the arc tube and a required emitted light color fails to be produced. Avoiding this situation demands that heater power be provided in addition to lamp power, since the heat conduction loss from the arc tube to the heater must be suppressed by supplying power to the heater coil even when the lamp is stably lit, and so a means such as this is in no way permissable if one considers the amount of consumption of vehicle batteries.

OBJECT OF THE INVENTION

It is an object of the present invention to provide a high pressure metal vapor discharge lamp in which there is no occurrence of discharge between a preheating heater and lead wires of an arc tube in an outer tube at the time of lamp ignition, supply of power to the heater during lamp rated operation is unnecessary, and the lamp rise time can be shortened.

It is another object of the present invention to provide a high pressure metal vapor discharge lamp in which using a ceramic heater as a pre-heater for an arc tube, it is both possible to improve the efficiency of emission of far infrared radiation and at the same time, to prevent the occurrence of cracks in the ceramic itself.

SUMMARY OF THE INVENTION

According to one aspect of the present invention, there is provided a high pressure metal vapor discharge lamp comprising:

an outer bulb having a seal portion;

an arc tube enclosed within said outer bulb, the arc tube having at least a pair of electrodes and containing at least a light emitting material and a rare gas;

a pair of first lead wires, one ends of the first lead wires connect to the electrodes respectively and another ends of the first lead wires mounted at the seal portion of outer bulb;

a pre-heater disposed within the outer bulb, the preheater comprises a heat element and an insulating material covers the heat element, and facing the arc tube to give the heat to the arc tube; and a second lead wires connected to the heat element of pre-heater, the portion of the second lead wires which are exposed in the outer bulb are surrounded by a heat-resisting insulator, and the base portion of the second lead wires are mounted at the seal portion of outer bulb.

BRIEF DESCRIPTION OF THE DRAWINGS

FIGS. 1 and 2 show a first embodiment of a high pressure metal discharge lamp according to the present invention, in which:

FIG. 1 is a longitudinal section of a small size metal halide lamp for a vehicle headlight;

FIG. 2 is a perspective view showing an assembly structure of a pre-heater for the high pressure metal vapor discharge lamp as shown in FIG. 1;

FIGS. 3 through 5 show a second embodiment of a high pressure metal vapor discharge lamp according to the present invention, in which:

FIG. 3 is a perspective view showing an arc tube and a pre-heater;

FIG. 4 is a side view in the direction of an arrow IV in FIG. 3;

FIG. 5 is a graph showing relationships between the electricity consumption of pre-heater and the surface temperature of pre-heater;

DETAILED DESCRIPTION OF THE PREFERRED EMBODIMENTS

Figure 1:
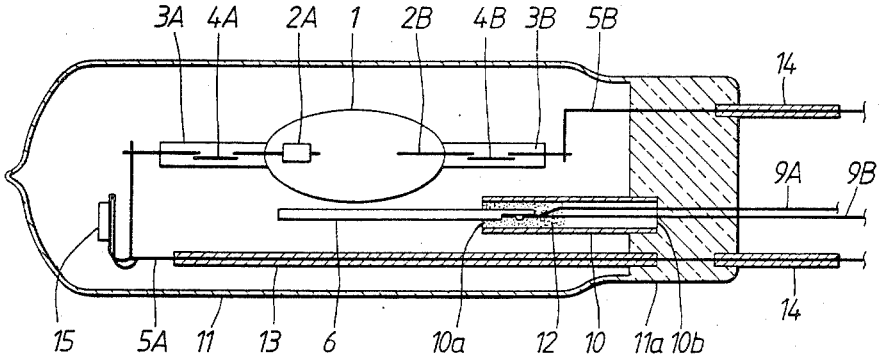
Figure 2:
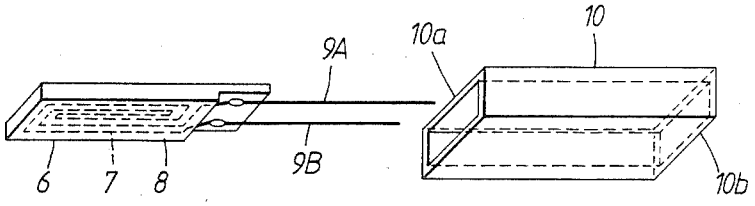

A first embodiment of a high pressure metal vapor discharge lamp according to the present invention will now be described in detail with reference to FIGS. 1 and 2. FIG. 1 is a longitudinal section of a 35W small size metal halide lamp. An anode 2A and cathode 2B are provided facing one another at opposite end portions of a arc tube 1. Anode 2A and cathode 2B are connected to a pair of first lead wires 5A and 5B by molybdenum foils 4A and 4B that are hermetically sealed and bonded in seal portions 3A and 3B. Mercury, scandium metal and metal halides constituted by scandium iodide and sodium iodide as light emitting materials, and a rare gas for start-up, are sealed in arc tube 1. In an outer bulb 11, a rated 30W pre-heater 6 is installed at a distance of 0.1 mm–1.2 mm from arc tube 1 so as to give the heat to arc tube 1. Pre-heater 6 is comprises a heating element 7 in the form of a tungsten wire and a ceramic 8 as an insulating material covers heating element 7. A pair of second lead wires 9A and 9B are inserted into a first end 10*a* and led out of a second end 10*b* of a glass tube 10 which open at opposite ends 10*a* and 10*b* as shown in FIG. 2. The led out of second lead wires 9A and 9B are integrally sealed and bonded in a seal portion 11*a* formed by heating and crushing of one end portion of outer bulb 11 together with the second end of glass element 10. Inside portion of glass tube 10, a heat-resisting electrical insulator 12 such as a heat-resisting metal oxide, e.g., alumina, silica or magnesia, etc. is packed so as to covers lead wires 9A and 9B of pre-heater 6. In this embodiment, Alon Ceramic (Trade Name: Toagosei Chemical Industry Co., Ltd.), which is an adhesive in the form of a paste of alumina and silica, etc., was packed in this gap portion and hardened by heating after removing moisture included in Alon Ceramic by drying.

Since heat-resisting electrical insulator 12 is for the purpose of preventing second lead wires 9A and 9B of pre-heater 6 being exposed inside outer bulb 11, it is not necessarily essential to pack the whole of the interior of glass tube 10, but it is satisfactory if only first end 10a of glass tube 10 is packed as shown in FIG. 1.

The interior of outer bulb 11 is filled with nitrogen gas at about 600 torr. At least one lead wire 5A of them is covered with an insulator, e.g., a glass tube 13. Further, the portions of first lead wires 5A and 5B that are led out from seal portion 11a are covered by insulators 14 and 14 for preventing short-circuiting. At upper portion of outer bulb 11, a getter 15 which is a composition consists of zirconium and aluminum, is provided for absorbing hydrogen and oxygen existed in outer bulb 11. Although not shown in the Figures, there may also be a reflecting film bonded and formed in the top portion of outer bulb 11.

When a small metal halide lamp with this construction is incorporated in a lamp unit and formed as a vehicle headlight. Previously, a power is applied to pre-heater 6 at 1–3 minutes to warm pre-heater 6. As a result, since arc tube 1 receives the heat from pre-heater 6, arc tube 1 is warmed, therefore, mercury, scandium metal, scandium iodide and sodium iodide are vaporized in arc tube 1. Then, if a voltage consisting of an approximately 15–30 kV pulse voltage superimposed on 60–70V DC voltage is applied to electrodes 2A and 2B through first lead wires 5A and 5B, the lamp can be lit in a moment. This is the results of the facts that since the construction is made one in which there is no exposure of heating element 7 and second lead wires 9A and 9B of pre-heater 6 in outer bulb 11, no undesirable discharge occurs between first lead wires 5A and 5B and second lead wires 9A and 9B in outer bulb 11. And that sufficient pulse energy can be supplied to the lamp and lighting can be effected properly in a short time as there is similarly no undesirable discharge in outer bulb 11 between first lead wires 5A and 5B, since at least one of them is covered by a glass tube 13.

Further, since pre-heater 6 is installed separated from arc tube 1, no escape of heat of arc tube 1 via pre-heater 6 to the exterior when the lamp is stably lit. Therefore, power to pre-heater 6 can be cut without any fear of reduction of the luminous flux of the lamp after the lamp has come into a stable operation, and it is thus made possible to ease consumption of the vehicle batteries.

In the above first embodiment, first lead wire 5A is covered with glass tube 13 and second lead wires 9A and 9B are covered with glass element 10 as an electrical insulator, respectively. However, the present invention is not limited to glass material as the electrical insulator, and one of or both wires 5A and 5B and second lead wires 9A and 9B may be covered with $Al_2O_3$, $SiO_2$ or $ZrO_2$ etc. Further, if ceramic is used for outer bulb 11, one of or both wires 5A and 5B and second lead wires 9A and 9B may be covered with ceramic.

A second embodiment of the present invention will be described with reference to FIGS. 3 through 5. If no description is given, the constitution of the second embodiment is the same as that of the first embodiment.

Figure 3:
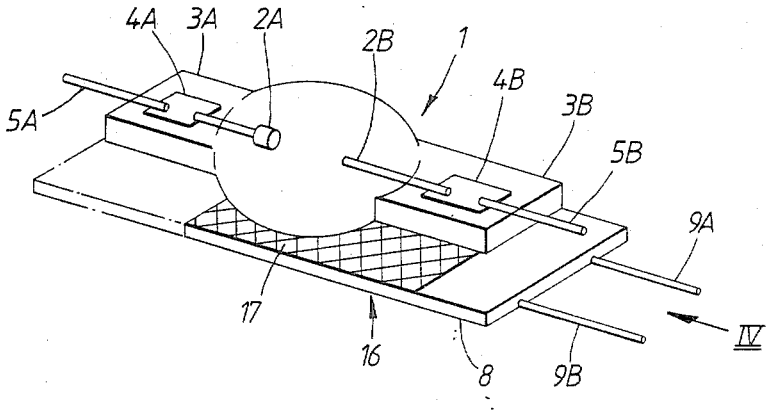
Figure 4:
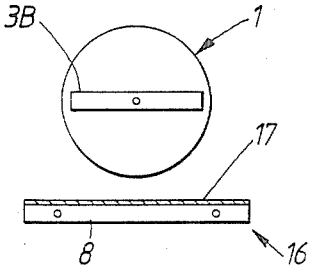

A carbon coating 17 is formed on the surface of ceramic 8 of a pre-heater 16, or at least on the surface facing arc tube 1 as shown in FIGS. 3 and 4. Pre-heater 16 may be of a size to face the full length of arc tube 1, as shown by the imaginary line in FIG. 3. However, since the metal halide lamp is lit by direct current, pre-heater 16 is constructed of a size to face arc tube 1 over its length from anode 2A to cathode 2B and seal portion 3B at the cathode 2B side, as shown by the solid line in FIG. 3, that is, excluding seal portion 3A at anode 2A side.

In this second embodiment, when the metal halide lamp is lit as described in first embodiment, in ceramic 8, since carbon coating 17 is formed on the surface facing arc tube 1, the heat generated from heating element 7 or tungsten will be conducted to carbon coating 17 through ceramic 8 and carbon coating 17 will emit far infrared radiation. In comparison with a pre-heater which emits far infrared radiation from ceramic 8 only, a pre-heater which is provided with this type of carbon coating 17 emits more far infrared radiation. Therefore, arc tube 1 rapidly can be heated without raising more necessarily the heating temperature of ceramic 8.

Figure 5:
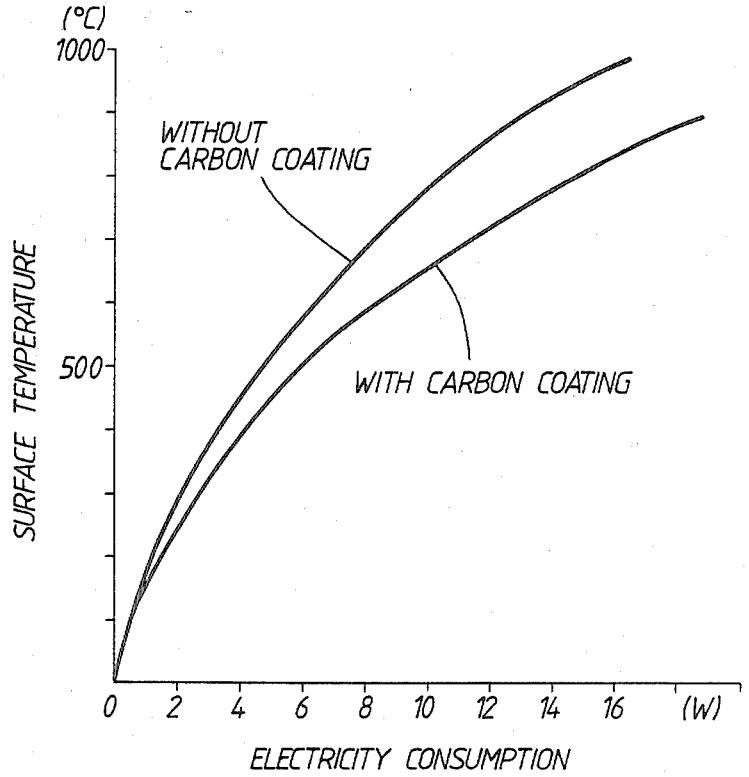

FIG. 5 is a graph which show the relationships between the electricity consumption of pre-heater 16 and the surface temperature of pre-heater 16 for one with carbon coating 17 provided on the surface of ceramic 8 and one without such provision. The power supplied to pre-heater 16 is consumed by the following.

(1) Heating pre-heater 16 itself.
(2) Heat conduction by the filled gases surrounds preheater 16.
(3) Emission of far infrared radiation from pre-heater 16.

If there is a vacuum in outer bulb 11, loss (2) does not occur. Moreover, even when there are filled gases, since the same conditions apply to the pre-heater with or without carbon coating 17 on the surface of ceramic 8, there is no need to compare loss (2). As shown on graph in FIG. 5, while the pre-heater with carbon coating 17 provided on the surface of ceramic 8 rose to 850° C. at an electricity consumption of 16W, the one without carbon coating 17 rose to 1,000° C. That is, even at identical electricity comsumptions, while, for the preheater without carbon coating 17, the proportion of (1) is large and the proportion of (3) is therefore smaller by that amount, for the pre-heater with carbon coating 17, the proportion of (1) is small but the proportion of (3) is larger by that amount. Since the limit of the working temperature may be considered as 850°–900° C. for cermic 8, no more than 10–12W can be supplied to the pre-heater without carbon coating 17. However, since the temperature is of the order of 850° C. even for a supply of 16W in the heater with carbon coating 17, there is no risk of cracks occurring.

When using pre-heater 16, impurity gases absorbed in ceramic 8 will be released in outer bulb 11 when the lamp is lit and will become a cause of blackening on the inner wall of outer bulb 11. To prevent this, it is desirable to heat ceramic 8 during exhaustion of outer bulb 11 by passing a current through heating element 7, thus causing the absorbed gases to be released from ceramic 8 and removed from outer bulb 11 to exterior.

Figure 6:
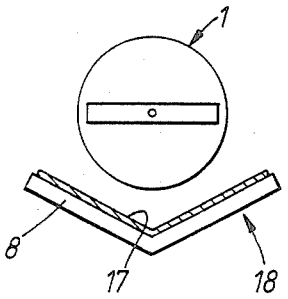
FIG. 6 is a side view of an arc tube and a pre-heater for a high pressure metal vapor discharge lamp as a third embodiment according to the present invention.
Figure 7:
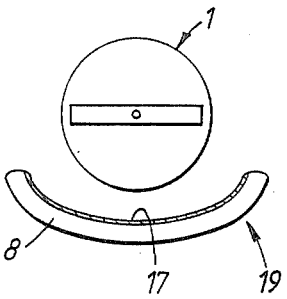
FIG. 7 is a side view of an arc tube and a pre-heater for a high pressure metal vapor discharge lamp as a fourth embodiment according to the present invention.

In the above second embodiment, the form of preheater 16 has been described as plate-shaped. However, the present invention is not limited to this embodiment. A pre-heater 18 may also be formed in a V-shape, as shown by a third embodiment given in FIG. 6. Further, a pre-heater 19 may also be formed in a U-shape, as shown by a fourth embodiment given in FIG. 7. Since pre-heaters 18 and 19 of the third and fourth embodiments are provided such as to surround arc tube 1, respectively, arc tube 1 is brought out more heat effectively.

Further, in above first through fourth embodiments, the metal halide lamp has been described. However, the present invention is not limited to these embodiments. It may be employed in other small size high pressure metal vapor discharge lamps such as high pressure sodium lamps, mercury-vapor lamps and etc. in which high-voltage pulses are imposed at the time of start-up.

Further more, the discharge lamp of the present invention is not limited to being the light source for a vehicle headlight, but is also very suitable as a light source for filming with video camera, projection lighting and etc. in which the lamp rise time have to be shortened.

As described in detail above, since the present invention has a construction such that there is no exposure of a heating element of pre-heater and lead wires thereof in an outer bulb, it is made possible to prevent the undesirable discharge between the pre-heater and lead wires of an arc tube in the outer bulb and effect instantaneous lighting at the time of lamp start-up. Further, once the lamp is stably lit there is no reduction of the luminous flux even if the supply of power to the pre-heater is cut, the discharge lamp permits saving of energy. Further more, when the lamp according to the present invention is used for a vehicle headlight, the pre-heater serves as a light shield plate to lead the light from the lamp to desired direction.

Further, as described in above second through fourth embodiments, since a carbon coating is formed on the surface of ceramic with a built-in heating element, there is effective as follows. That is, the heat from the heating element is conducted to the surface of the carbon coating through the ceramic. As a result, the carbon coating emits far infrared radiation and so, even with an identical power input to that of conventional types, the far infrared radiation is increased. Therefore, the heating efficiency of the arc tube is improved, and at the same time, the temperature of the ceramic itself is reduced so that the occurrence of cracks is prevented.

What is claimed as new and desired to be secured by Letters Patent of the United States is:

1. A high pressure metal vapor discharge lamp comprising:
an outer bulb having a seal portion;
an arc tube enclosed within said outer bulb, said arc tube having at leat a pair of electrodes and containing at least a light emitting material and a rare gas;
a first pair of lead wires, one end of which are connected to the electrodes in said arc tube and the other end of which are mounted at the seal portion of said outer bulb;
a pre-heater disposed within said outer bulb, said pre-heater having a heating element and an electrical insulating material covering the heating element, facing said arc tube for heating said arc tube; and
a second pair of lead wires, one end of which are connected to the heating element of said pre-heater and the other end of which are mounted at the seal portion of said outer bulb; and
an electrical insulating tube surrounds the portion of said second pair of lead wires which are within said outer bulb.

2. A lamp according to claim 1, wherein at least one lead wire of said first pair of lead wires which are within said outer bulb, is covered with an electrical insulator.

3. A lamp according to claim 1, wherein said electrical insulating material covering the heating element of said pre-heater is a ceramic.

4. A lamp according to claim 3, wherein the surface of said pre-heater facing said arc tube, is covered with a carbon coating.

5. A lamp according to claim 4, wherein said preheater is formed in a V-shape.

6. A lamp according to claim 4, wherein said preheater is formed in a U-shape.

7. A lamp according to claim 1, further comprising a heat-resisting electrical insulator which is packed in at least the internal gap at one end of said electrical insulating tube, and the other end of said electrical insulating tube is mounted at the seal portion of said outer bulb.

8. A lamp according to claim 7, wherein said electrical insulating tube is a glass.

9. A lamp according to claim 7, wherein said electrical insulating tube is a ceramic.

* * * * *